US009802793B2

(12) United States Patent
Kang et al.

(10) Patent No.: US 9,802,793 B2
(45) Date of Patent: Oct. 31, 2017

(54) FAST CRANE AND OPERATION METHOD FOR SAME

(71) Applicant: National Taiwan University, Taipei (TW)

(72) Inventors: Shih-Chung Kang, Taipei (TW); Thomas Kuo, Taipei (TW)

(73) Assignee: NATIONAL TAIWAN UNIVERSITY, Taipei (TW)

( * ) Notice: Subject to any disclaimer, the term of this patent is extended or adjusted under 35 U.S.C. 154(b) by 536 days.

(21) Appl. No.: 13/746,421

(22) Filed: Jan. 22, 2013

(65) Prior Publication Data

US 2014/0202970 A1 Jul. 24, 2014

(51) Int. Cl.
*B66C 13/06* (2006.01)

(52) U.S. Cl.
CPC ..... *B66C 13/06* (2013.01)

(58) Field of Classification Search
CPC ..... B66C 13/06; B66C 13/063; B66C 13/10; B66C 13/105; B66C 13/23; B66C 13/26; B66C 2700/081; B66C 2700/082
USPC ..... 212/272, 275, 273, 270
See application file for complete search history.

(56) References Cited

U.S. PATENT DOCUMENTS

| | | | | | |
|---|---|---|---|---|---|
| 3,517,830 | A * | 6/1970 | Virkkala | 212/275 |
| 3,921,818 | A * | 11/1975 | Yamagishi | 212/275 |
| 4,512,711 | A * | 4/1985 | Ling et al. | 414/800 |
| 4,603,783 | A * | 8/1986 | Tax et al. | 212/275 |
| 4,997,095 | A * | 3/1991 | Jones et al. | 212/275 |
| 5,713,477 | A * | 2/1998 | Wallace et al. | 212/270 |
| 5,806,695 | A * | 9/1998 | Hytonen | 212/270 |
| 5,960,969 | A * | 10/1999 | Habisohn | 212/275 |
| 5,961,563 | A * | 10/1999 | Overton | 701/50 |
| 6,631,300 | B1 * | 10/2003 | Nayfeh et al. | 700/55 |
| 7,627,393 | B2 * | 12/2009 | Sawodny et al. | 700/228 |
| 8,235,229 | B2 * | 8/2012 | Singhose | B66C 13/063 212/272 |
| 2006/0175276 | A1 * | 8/2006 | Hytonen | 212/275 |
| 2009/0050593 | A1 * | 2/2009 | Ladra et al. | 212/275 |
| 2012/0234787 | A1 * | 9/2012 | Ueda et al. | 212/275 |

* cited by examiner

*Primary Examiner* — Sang Kim
*Assistant Examiner* — Juan Campos, Jr.
(74) *Attorney, Agent, or Firm* — Muncy, Geissler, Olds & Lowe P.C.

(57) ABSTRACT

A fast crane and an operation method for the same are provided. The operation method includes calculating a pendulum period and moving the object. The pendulum period of the cable is calculated. The object is moved with an acceleration during an active time based on the pendulum period.

14 Claims, 4 Drawing Sheets

FAST CRANE AND OPERATION METHOD FOR SAME

TECHNICAL FIELD

The present disclosure relates to a crane, and more particularly to a fast crane and an operation method for the same.

BACKGROUND

In general, cranes are one of the most heavily used instruments in construction base sites. There are more than 125,000 cranes operating in the construction industry in United States. Because so many construction activities rely on cranes for moving structural and nonstructural components, the efficiency of the crane operation can influence the entire project progress. However it is always challenging to maintain efficiency of crane operations and the safety of the site. This is especially true in high-rise construction where cranes play a particularly critical role in the overall construction schedule. The challenge for crane operation is the trade-off between the speed/efficiency and the safety.

Cranes are often in charge of the tasks in the critical path of construction schedule. The speed of crane erections can significantly influence the overall project progress. A fast crane operation may result in large sway of the hanging object and causes the safety concerns in the high-speed operation. Accordingly, novice operators usually slow down the crane motions to reduce the sway to ensure the safety of the operation. Although this seems reasonable, the accumulation of hundreds or even thousands slower erection cycles may influence the overall project productivity significantly. Experienced crane operators usually develop the skill and intuition of the crane control for increasing the efficiency and safety of the crane operation. They often vary the speed of the rotation to control the overall vibration in the erection cycle.

There is a prior velocity control method for preventing oscillations in crane, as disclosed in U.S. Pat. No. 5,550,733 (called Case A hereafter), issued on Aug. 27, 1996. Case A applies a closed circuit during the carrying for feeding back the oscillations of the object so as to quickly damping them. The tower crane is a large-scale machine operated at outdoor construction environment. The closed circuit is a close-loop control system which is suitable for use of a small scale machine, but it is difficult to use with the tower crane motor for controlling the suggested precise moving to and fro. Accordingly, an open-loop control system is more suitable for use of the tower crane.

First Referring to FIG. 1, there is shown an ideal model of a tower crane suspended system. The model is a 2D in-plane version of the 3D simulations. The figure illustrates a rigging system that is the hanging system of the tower crane. The crane has a jib 10, a trolley 11, a hook block 12 and a hook 13. Rigging a beam element 14 in the plane perpendicular to crane jib 10 is shown in FIG. 1. There are steel cables 15, 16 under trolley 11. Cables 15, 16 are of low damping and difficult to cease the oscillation. Referring to FIG. 2, an idealized double pendulum model for the tower crane can be found. The model uses a first frictionless pin 20, a first mass-less rigid bar 21, a first rigid connection 22 with a mass $m_1$, a second frictionless pin 23, a second mass-less rigid bar 24, a second rigid connection 25 with a mass $m_2$ and the mass $m_2$ is a rigid object 26. The double pendulum model can more realistically simulate the behavior of the hanging system, for example, including hanging object 14, hook 13 and cables 15, 16, of the crane.

Referring to FIG. 3, the free body diagram of the double pendulum under operation is shown. The double pendulum are with two mass-less rigid bars, the important parameters are $L_1$, $L_2$, $m_1$, and $m_2$, the pendulum length and the suspended mass respectively. The free body diagram depicts the pendulum under external force on the pivot, i.e. pin 23. The arrows indicate the static force directions to the right and to the bottom of the diagram when the pivot acceleration is to the left. The double pendulum equations are as follows:

$$\begin{bmatrix} (m_1+m_2)L_1^2 & m_2L_1L_2 \\ m_2L_1L_2 & I_G+m_2L_2^2 \end{bmatrix}\begin{Bmatrix} \ddot{\theta}_1 \\ \ddot{\theta}_2 \end{Bmatrix}+\begin{bmatrix} (m_1+m_2)gL_1 & 0 \\ 0 & m_2gL_2 \end{bmatrix}\begin{Bmatrix} \theta_1 \\ \theta_2 \end{Bmatrix}=\begin{Bmatrix} (P_1+P_2)L_1 \\ P_2L_2 \end{Bmatrix}, \quad (1)$$

where $\theta_1$, $\theta_2$ are the rotation angles of double pendulum, $\ddot{\theta}_1$, $\ddot{\theta}_2$ the angular acceleration, $P_1$, $P_2$ the external forces acting on mass $m_1$, $m_2$. There is almost no control mechanism for the fast crane in the prior art. The acceleration input by the moving motor of the crane should be controlled.

Therefore, how to solve the problems of the oscillation of the steel cable for the crane are solved in the present invention. The inventors endeavor in the experiments, tests and researches to obtain a fast crane and an operation method for the same, which not only resolves the drawback of the oscillation of the hanging object, but also achieves the convenience that the moving time of the hanging object is shortened. Namely, the subject matters to be resolved in the present invention are how to overcome the problem that the sway angle is too large for the hanging object, and consequently the shortening of the moving time of the hanging object is feasible, how to overcome the problem that there is no acceleration between the first and the second accelerations, and how to overcome the problem that the time for the second accelerations is relative to the desired operation maximum speed. The present disclosure aims to develop a simple control method for the fast crane operations. The sway angle should be limited to maintain the controllability and safety. A fast crane based on the prior double pendulum equations will be established according to the embodiments of the present disclosure.

SUMMARY

In an operation method for a fast crane having a cable with two segments hanging an object according to a piecewise acceleration schedule for moving the object to constrain the object to sway for a cycle of a pendulum period of the cable only and to sway within a maximum swaying angle during moving. The operation method includes calculating the pendulum period, moving the object, moving the object with a first constant speed and moving the object. The pendulum period of the cable is calculated. The object is moved with a first acceleration during a first stage time based on the pendulum period. The body is moved with a first constant speed during a second stage time. The object is moved with a second acceleration during a third stage time.

In an operation method for a crane having a cable hanging an object, the operation method includes calculating a pendulum period and moving the object. The pendulum period of the cable is calculated. The object is moved with an acceleration during an active time based on the pendulum period.

In a crane having a cable for hanging an object, the crane includes a first calculator and a second calculator. The first calculator calculates a pendulum period of the cable. The second calculator calculates an acceleration for moving the object during an active time based on the pendulum period.

The present disclosure may best be understood through the following descriptions with reference to the accompanying drawings, in which:

DETAILED DESCRIPTION OF THE EMBODIMENT

Figure 3:
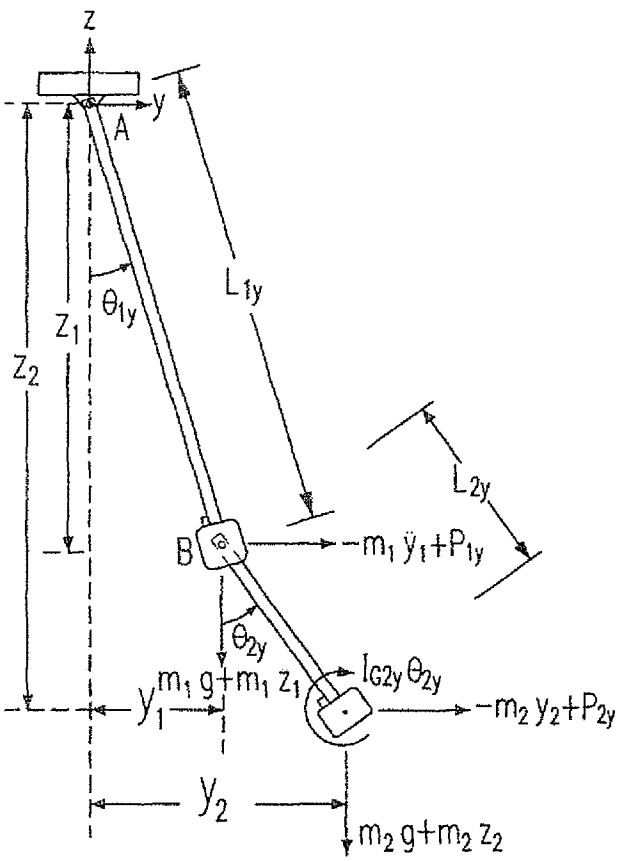
Fig. 3 (Prior Art)
FIG. 3 is a schematic diagram of the free body according to FIG. 2.
Figure 2:
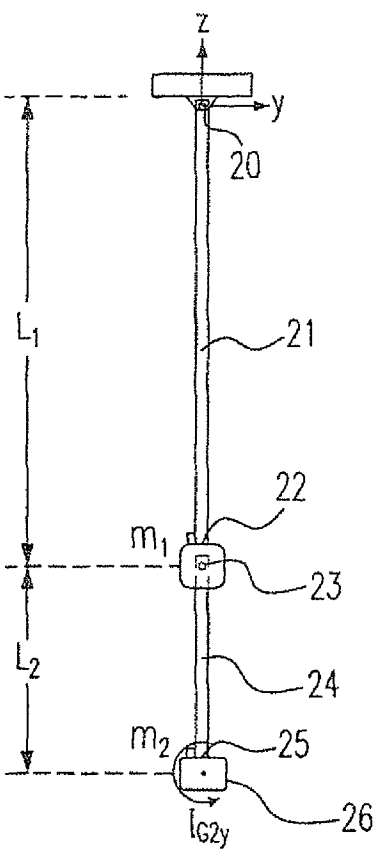
Fig. 2 (Prior Art)
FIG. 2 is a schematic diagram of the idealized model of the tower crane suspended system according to FIG. 1.
Figure 1:
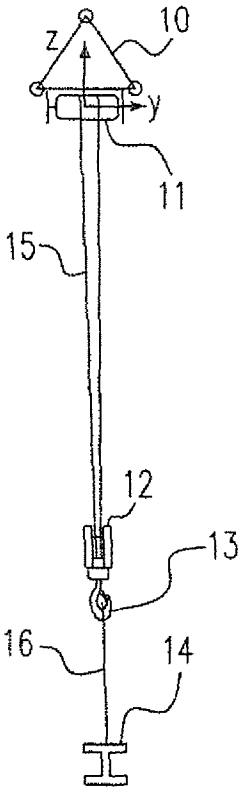
Fig. 1 (Prior Art)
FIG. 1 is a schematic diagram of the rigging system of the tower crane according to the prior art.

The present disclosure will be described with respect to particular embodiments and with reference to certain drawings, but the disclosure is not limited thereto but is only limited by the claims. The drawings described are only schematic and are non-limiting. In the drawings, the size of some of the elements may be exaggerated and not drawn on scale for illustrative purposes. The dimensions and the relative dimensions do not necessarily correspond to actual reductions to practice.

Figure 4:
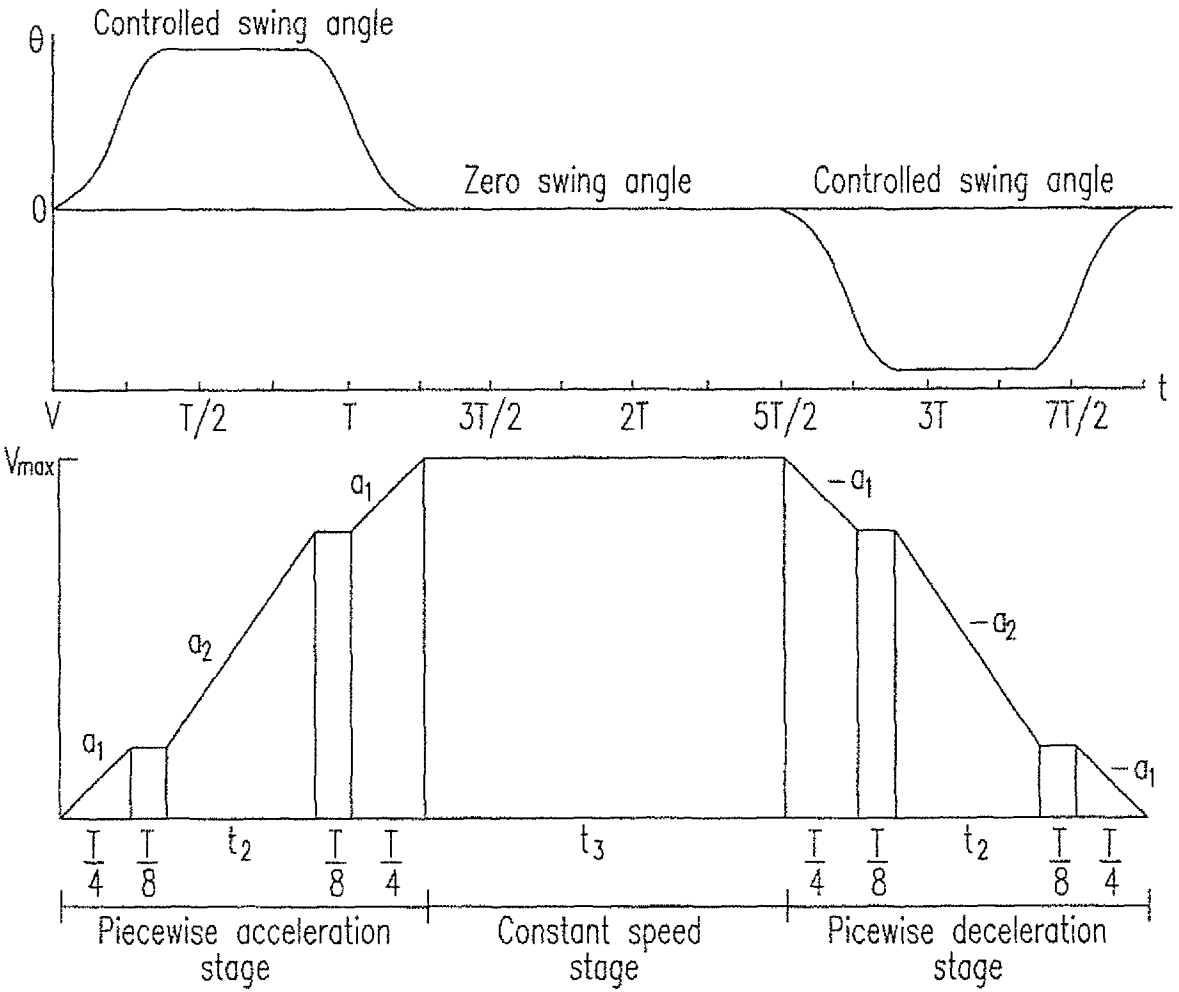
FIG. 4 is a schematic diagram of the concept embodiment of the operation procedure of a fast crane and an operation method for the same according to the present disclosure.

Referring to FIG. 4, a schematic diagram of the concept embodiment of a fast crane and an operation method for the same according to the present disclosure is shown. The operation method for the fast crane has a cable. The cable has two segments of cables 15, 16. An object, for example, a beam 14, is hanged by cable 16, a pendulum period T of the respective cables 15, 16 is calculated by the equation $T=2\pi\sqrt{L/g}$. There is a piecewise acceleration stage at the beginning. The object is moved with a first acceleration $a_1$ during a first stage time based on pendulum period T. The body is moved with a first constant speed during a second stage time. The object is moved with a second acceleration during a third stage time.

The operation method further includes a step in which the body is moved with a second constant speed during a fourth stage time. The first stage time is a quarter of pendulum period T, i.e. T/4, the second stage time and the fourth stage time are one eighth of pendulum period T, i.e. T/8, the third stage time $t_2=(v_{max}-a_1\cdot T/2)/a_2$, where $v_{max}$ a desired operation maximum speed, $a_1$ is the first acceleration, T is the pendulum period, $a_2$ is the second acceleration, and there is a relation function of $$a_2 = g\cdot\tan\left(\sqrt{2}\cdot\tan^{-1}\left(\frac{a_1}{g}\right)\right),$$

where g represents a gravity. The method further includes a step in which the object is accelerated with first acceleration $a_1$ during a fifth stage time. The fifth stage time is a quarter of pendulum period T, i.e. T/4, and the piecewise acceleration stage is finished.

Subsequently, a constant speed stage is followed. The method further includes a step which the body is moved with a third constant speed during a rapidest moving stage time $t_3$. The fifth stage time is followed by rapidest moving stage time $t_3$. The third constant speed is the desired operation maximum speed. And the final stage is the piecewise deceleration stage. The method further includes a step in which the object is decelerated with a first deceleration $-a_1$ during a sixth stage time. First deceleration $-a_1$ has a first modulus, i.e. the absolute value, equal to that of first acceleration $a_1$ and the sixth stage time is a quarter of the pendulum period, i.e. T/4. The method further includes a step in which the body is moved with a fourth constant speed during a seventh stage time.

The fourth constant speed is equal to the second constant speed and the seventh stage time is one eighth of pendulum period T, i.e. T/8. The method further includes a step in which the object is decelerated with a second deceleration $-a_2$ during an eighth stage time. Second deceleration $-a_2$ has a second modulus equal to that of second acceleration $a_2$ and the eighth stage time $t_2$ is equal to the third stage time $t_2$. The method further includes a step in which the body is moved with a fifth constant speed during a ninth stage time. The fifth constant speed is equal to the first constant speed and the ninth stage time is one eighth of pendulum period T, i.e. T/8. The method further includes a step in which the object is decelerated with first deceleration $-a_1$ during a tenth stage time. The tenth stage time is a quarter of pendulum period T, i.e. T/4. Second acceleration $a_2$ is calculated based on first acceleration $a_1$. The formula for calculating a total distance d for this plan in the FIG. 4 is $$d = \frac{3}{8}\cdot a_1\cdot T^2 + \frac{1}{2}\cdot a_1\cdot T\cdot t_2 + a_2\cdot t_2^2 + \frac{3}{4}\cdot a_2\cdot T\cdot t_2 + \frac{1}{2}\cdot a_1\cdot T\cdot t_3 + a_2\cdot t_2\cdot t_3.$$

The accelerations $a_1$, $a_2$ applied in sequence may be 4 m/s$^2$, 6.3 m/s$^2$, and 4 m/s$^2$. The accelerations are in general agreement with $a_2=g\cdot\tan(\sqrt{2}\cdot\tan^{-1}(a_1/g))$, for the purpose that the sway angle is controlled in FIG. 4.

Figure 5:
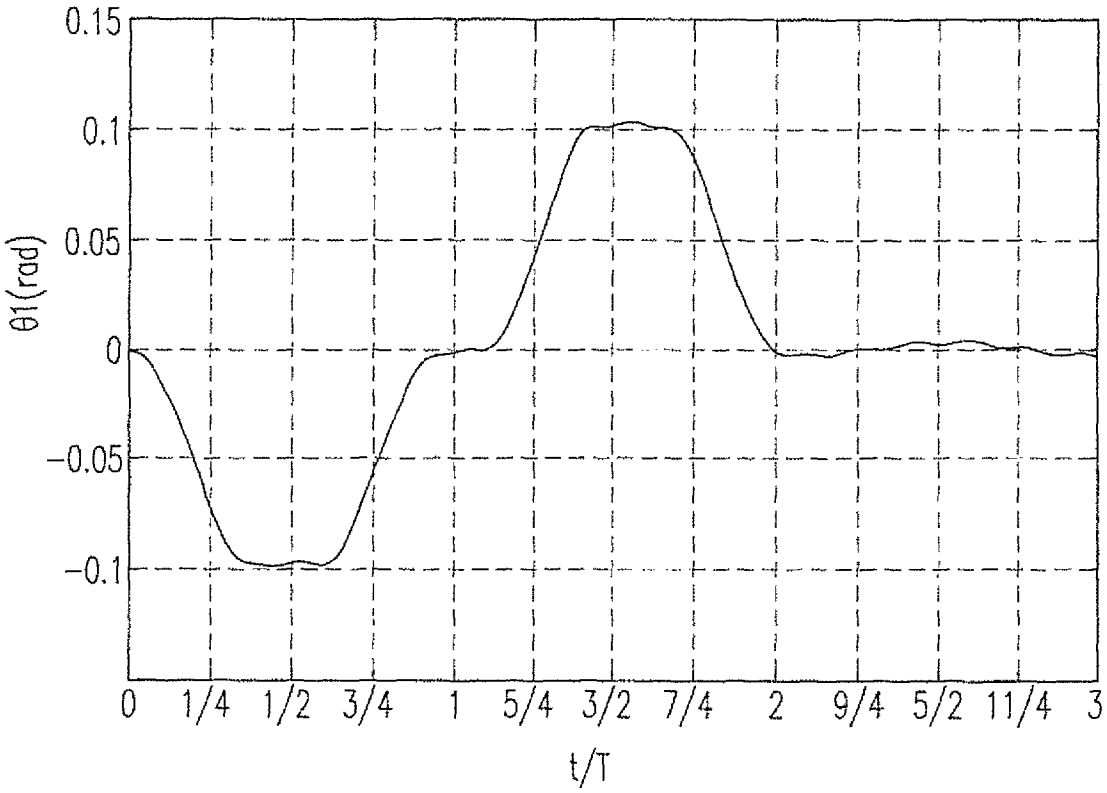
FIG. 5 is a schematic diagram of the computed sway angle $\theta_1$ of the crane as a function of time according to FIG. 4.

Referring to FIG. 5, a schematic diagram of the computed sway angle $\theta_1$ of the crane as a function of time according to FIG. 4 is shown. The longitudinal axis is the sway angle $\theta_1$ and the horizontal axis is the time (s/period). It can be mainly understood the skill characteristic which is for the crane to hang the object at a sway locus by FIG. 5. The feature of the sway locus is less vibration and the course thereof can be foreknown for decrease the safety concerns of the construction sites. The computational layout includes selecting the maximum sway angle $\theta_1$ of the operation, which determines the $a_1$. In order to test the stability of the above control plan, it has performed sensitivity experiment by perturbing 10% of the relevant parameters such as $a_2$, $t_2$, and $t_3$. The results are similar to the unperturbed experiments. It can use the acceleration $a_2$=0.90 m/s$^2$ which is 10% perturbation from the original 0.99 m/s$^2$.

A table is the numerical experiment which counts the operation time required by the control methods of the prior crane and the present fast crane. The control method of the fast crane can shorten a considerable time of the operation time. The longer is the operation distance, the higher is the benefit ratio. The table is shown as follows:

| Time (s) | Prior crane | Control method of fast crane |
|---|---|---|
| 25 m | 20.9 s (100%) | 14.5 s (69%) |
| 50 m | 41.3 s (100%) | 19.6 s (47%) |
| Ratio | 1.97 | 1.35 |

Figure 6:
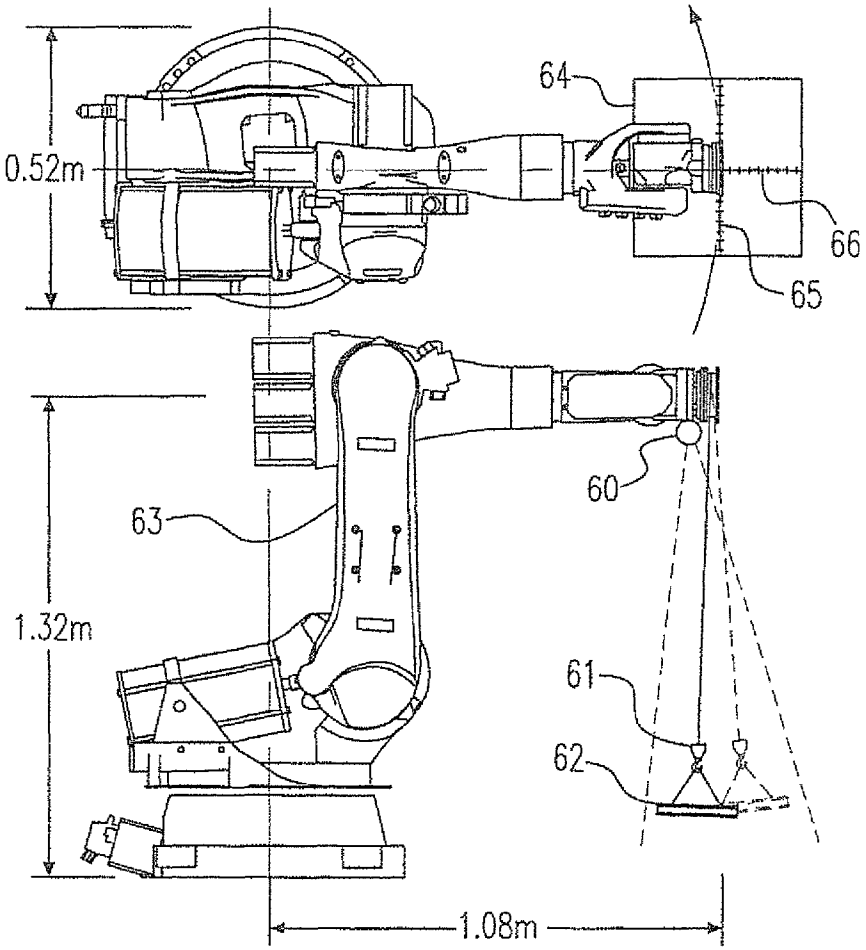
FIG. 6 is a schematic diagram of the experiment implementation in KUKA™ KR 16 CR robotic arm according to the present disclosure.

Referring to FIG. 6, an experiment implementation in KUKA™ KR 16 CR robotic arm is shown. The lateral/bird view is in the lower/upper figure. The double pendulum experiment may be set as T=1.99 s, $a_1$=0.50 m/s$^2$, $a_2$=0.7 m/s$^2$, d=2.42 m, and from a prescribed $t_2$ it will get $t_3$. The parameters are selected according to the KUKA robotic aim scaled crane model. The scaled model is a reduced similarity of the real crane.

In some embodiments, the operation method for the crane having the cable hanging the object, the operation method includes calculating pendulum period T and moving the object. Pendulum period T of the cable is calculated. The object is moved with an acceleration, e.g. first acceleration $a_1$, during an active time, e.g. the first stage time, based on pendulum period T. The active time, for example, third stage time $t_2$, is calculated based on the acceleration.

In some embodiments, the crane has the cable for hanging the object. The crane includes a first calculator, for example, a software, and a second calculator. The first calculator calculates pendulum period T of the cable. The second calculator calculates an acceleration, for example, second acceleration $a_2$, for moving the object during an active time, for example, third stage time $t_2$, based on pendulum period T. The first calculator is the second calculator.

Referring to FIG. 6, there is shown a camera 60, a scaled hook 61, a scaled beam 62, a KUKA™ KR 16 CR robotic arm 63, a camera view 64, a tangential distance 65 and a radial distance 66. The validation test was conducted by using robotic arm 63. The experiment is considered to be a scaled crane model with one fiftieth or one hundredth scaled parameter. According to the scaled model, a 5 seconds KUKA operation time in model operation is corresponding to 50 seconds pratical operation time in real crane operation. The horizontal/vertical distance to the reference point is tangential/radial distance 65/66 during the operation, shown as the upper panel in FIG. 6.

There are further embodiments provided as follows.

Embodiment 1

In an operation method for a crane having a cable hanging an object, the operation method includes calculating a pendulum period, moving the object, moving the object with a first constant speed and moving the object. The pendulum period of the cable is calculated. The object is moved with a first acceleration during a first stage time based on the pendulum period. The body is moved with a first constant speed during a second stage time. The object is moved with a second acceleration during a third stage time.

Embodiment 2

In the method according to the above-mentioned embodiment, the method further includes a step of moving the object with a second constant speed during a fourth stage time.

Embodiment 3

In the method according to the above-mentioned embodiment 1 or 2, the first stage time is a quarter of the pendulum period, the second stage time and the fourth stage time are one eighth of the pendulum period, and the third stage time $t_2=((v_{max}-a_1 \cdot T/2)/a_2$, where $v_{max}$ is a desired operation maximum speed, $a_1$ is the first acceleration, T is the pendulum period, $a_2$ is the second acceleration, and there is a relation function of $$a_2 = g \cdot \tan\left(\sqrt{2} \cdot \tan^{-1}\left(\frac{a_1}{g}\right)\right),$$

where g represents a gravity.

Embodiment 4

In the method according to any one of the above-mentioned embodiments 1-3, the method further includes a step of accelerating the object with the first acceleration during a fifth stage time.

Embodiment 5

In the method according to any one of the above-mentioned embodiments 1-4, the fifth stage time is a quarter of the pendulum period.

Embodiment 6

In the method according to any one of the above-mentioned embodiments 1-5, the method further includes a step of moving the object with a third constant speed during a rapidest moving stage time. The fifth stage time is followed by the rapidest moving stage time.

Embodiment 7

In the method according to any one of the above-mentioned embodiments 1-6, the method further includes a step of decelerating the object with a first deceleration during a sixth stage time.

Embodiment 8

In the method according to any one of the above-mentioned embodiments 1-7, the first deceleration has a first modulus equal to that of the first acceleration, and the sixth stage time is a quarter of the pendulum period.

Embodiment 9

In the method according to any one of the above-mentioned embodiments 1-8, the method further includes a step of moving the object with a fourth constant speed during a seventh stage time.

Embodiment 10

In the method according to any one of the above-mentioned embodiments 1-9, the forth constant speed is equal to the second constant speed, and the seventh stage time is one eighth of the pendulum period.

Embodiment 11

In the method according to any one of the above-mentioned embodiments 1-10, the method further includes a step of decelerating the object with a second deceleration during an eighth stage time.

Embodiment 12

In the method according to any one of the above-mentioned embodiments 1-11, the second deceleration has a second modulus equal to that of the second acceleration, and the eighth stage time is equal to the third stage time.

Embodiment 13

In the method according to any one of the above-mentioned embodiments 1-12, the method further includes a step of moving the object with a fifth constant speed during a ninth stage time.

Embodiment 14

In the method according to above-mentioned embodiment 1-13, the fifth constant speed is equal to the first constant speed. The ninth stage time is one eighth of the pendulum period.

Embodiment 15

In the method according to the above-mentioned embodiment 1-14, the method further includes a step of decelerating the object with the first deceleration during a tenth stage time and the tenth stage time is a quarter of the pendulum period.

Embodiment 16

In the method according to any one of the above-mentioned embodiments 1-15, the second acceleration is calculated based on the first acceleration.

Embodiment 17

In an operation method for a crane having a cable hanging an object, the operation method includes calculating a pendulum period and moving the object. The pendulum period of the cable is calculated. The object is moved with an acceleration during an active time based on the pendulum period.

Embodiment 18

In the method according to the above-mentioned embodiment 17, the active time is calculated based on the acceleration.

Embodiment 19

In a crane having a cable for hanging an object, the crane includes a first calculator and a second calculator. The first calculator calculates a pendulum period of the cable. The second calculator calculates an acceleration for moving the object during an active time based on the pendulum period.

Embodiment 20

In the method according to the above-mentioned embodiment 19, the first calculator is the second calculator.

It is concluded the present disclosure can reach high speed operation with zero sway angles by using multiple accelerations and decelerations, so it can be confirmed that the first constant speed is really a zero acceleration between the first and the second accelerations, and really able to accomplish the purpose of using the desired operation maximum speed to calculate the time for the second accelerations.

While the disclosure has been described in terms of what are presently considered to be the most practical and exemplary embodiments, it is to be understood that the disclosure need not be limited to the disclosed embodiment. On the contrary, it is intended to cover various modifications and similar arrangements included within the spirit and scope of the appended claims, which are to be accorded with the broadest interpretation so as to encompass all such modifications and similar structures. Therefore, the above description and illustration should not be taken as limiting the scope of the present disclosure which is defined by the appended claims.

What we claim is:

1. An operation method for a crane having a cable with two segments hanging an object according to a piecewise acceleration schedule for moving the object to constrain the object to sway for a cycle of a pendulum period of the cable only and to sway within a maximum swaying angle during moving, comprising:

calculating the pendulum period of the cable;

performing the piecewise acceleration schedule comprising the following steps in sequence:

moving the object with a first acceleration during a first stage time;

continuously moving the object with a first constant speed during a second stage time; and continuously moving the object with a second acceleration during a third stage time;

continuously moving the object with a second constant speed during a fourth stage time; and continuously moving the object with the first acceleration during a fifth stage time;

wherein the first acceleration, the second acceleration, the first constant speed, the second constant speed, the first stage time, the second stage time, the third stage time, the fourth stage time and the fifth stage time are calculated based on the pendulum period and the maximum swaying angle, so as to constrain the object to sway for the cycle only and within the maximum swaying angle during moving.

2. A method according to claim 1, wherein the first stage time is a quarter of the pendulum period, the second stage time and the fourth stage time are one eighth of the pendulum period, and the third stage time $t_2=(v_{max}-a_1 \cdot T/2)/a_2$, where $v_{max}$ is a desired operation maximum speed, $a_1$ is the first acceleration, T is the pendulum period, $a_2$ is the second acceleration, and there is a relation function of $$a_2 = g \cdot \tan\left(\sqrt{2} \cdot \tan^{-1}\left(\frac{a_1}{g}\right)\right),$$

where g represents a gravity.

3. A method according to claim 1, wherein the fifth stage time is a quarter of the pendulum period.

4. A method according to claim 1, further comprising a step of moving the object with a third constant speed during a rapidest moving stage time following the fifth stage time.

5. A method according to claim 4, further comprising a step of decelerating the object with a first deceleration during a sixth stage time.

6. A method according to claim 5, wherein the first deceleration has a first modulus equal to that of the first acceleration, and the sixth stage time is a quarter of the pendulum period.

7. A method according to claim 5, further comprising a step of moving the object with a fourth constant speed during a seventh stage time.

8. A method according to claim 7, wherein the fourth constant speed is equal to the second constant speed, and the seventh stage time is one eighth of the pendulum period.

9. A method according to claim 7, further comprising a step of decelerating the object with a second deceleration during an eighth stage time.

10. A method according to claim 9, wherein the second deceleration has a second modulus equal to that of the second acceleration, and the eighth stage time is equal to the third stage time.

11. A method according to claim 9, further comprising a step of moving the object with a fifth constant speed during a ninth stage time.

12. A method according to claim 11, wherein the fifth constant speed is equal to the first constant speed, and the ninth stage time is one eighth of the pendulum period.

13. A method according to claim 11, further comprising a step of decelerating the object with the first deceleration during a tenth stage time and the tenth stage time is a quarter of the pendulum period.

14. A method according to claim 1, wherein the second acceleration is calculated based on the first acceleration.

* * * * *